US005289223A

United States Patent [19]

Woog

[11] Patent Number: 5,289,223

[45] Date of Patent: * Feb. 22, 1994

[54] CHEMICAL RECYCLER FOR PHOTO PROCESSING MACHINE

[76] Inventor: Gunter Woog, 5435 Bauers Dr., West Bend, Wis. 53095

[ * ] Notice: The portion of the term of this patent subsequent to Oct. 15, 2008 has been disclaimed.

[21] Appl. No.: 775,917

[22] Filed: Oct. 15, 1991

Related U.S. Application Data

[63] Continuation-in-part of Ser. No. 617,522, Nov. 23, 1990, Pat. No. 5,057,858.

[51] Int. Cl.[5] ..... G03D 3/02

[52] U.S. Cl. ..... 354/324

[58] Field of Search ..... 354/299, 319-322, 354/324, 325; 137/563, 565; 134/64 R, 64 P, 122 P, 122 R

[56] References Cited

U.S. PATENT DOCUMENTS

| | | | |
|---|---|---|---|
| 3,557,752 | 1/1971 | Hakanson | 354/324 X |
| 3,990,088 | 11/1976 | Takita | 354/298 |
| 4,349,267 | 9/1982 | Ohtani | 354/324 X |
| 4,506,986 | 3/1985 | Freeman | 354/324 X |
| 4,577,950 | 3/1986 | Mackson | 354/324 |
| 4,650,339 | 3/1987 | Chetcuti et al. | 354/324 X |
| 4,728,408 | 3/1988 | Palazzolo | 204/229 |
| 4,804,452 | 2/1989 | Rhodes | 204/238 |
| 5,023,643 | 6/1991 | Lynch et al. | 354/299 |

*Primary Examiner*—D. Rutledge

*Attorney, Agent, or Firm*—Ryan, Kees & Hohenfeldt

[57] ABSTRACT

A device for recycling developer fixer into a photo processing machine. The device includes containers for containing chemicals coming out of overflow outlets of the photo processing machine. The chemicals flow into the container, and a portion thereof are recycled and returned together with fresh chemicals to the processing machine. A portion of the used chemicals are discharged to a drain. The recycled chemicals can either be pumped into an automixer where the fresh chemicals are added or directly into the inlet line to the photo processor tank where fresh chemicals are simultaneously also input. Alternately, the overflow can be directed to the automixer first and either returned directly therefrom, or optionally, by way of a separate container, to the photo processing machine.

11 Claims, 2 Drawing Sheets

CHEMICAL RECYCLER FOR PHOTO PROCESSING MACHINE

This is a continuation-in-part of copending application Ser. No. 07/617,522 filed Nov. 23, 1990, U.S. Pat. No. 5,057,858.

BACKGROUND OF THE INVENTION

This invention relates to photo processing machines, and in particular to apparatus for automating the recycling of developer and fixer chemicals in such machines.

In my co-pending application Ser. No. 07/617,522 filed Nov. 23, 1990 I described a system for recycling photographic developer. I have now discovered that similar principles can be utilized in connection with photographic fixers, as well. I have also discovered further ways to provide for recycling of both developers and fixers in small photo finishing equipment.

To date, it has been difficult and expensive to reuse and recycle fixers and developers. There are those who believe that it is merely necessary to cut back the replenisher rate for each film. For instance, if the normal rate is 100 cc, the recycling could be accomplished by reducing it to 50 cc. The problem with that approach, however, is that it does not account for the buildup of certain salts that can act to inhibit the photographic fixing process. The only way to avoid such a buildup is to redilute the used fixer with new fixer while continually removing a portion of the used chemicals.

The only method for doing so to date has been practiced only in large photo finishing plants and large hospitals, both of which have central mixing facilities. In those cases an operator could isolate several hundred gallons of used fixer and reintroduce that fixer into several hundred more gallons of new fixer. This process is expensive even for such large companies because of the labor-intensive nature of the work, and is simply unavailable for smaller companies.

SUMMARY OF THE INVENTION

This invention relates to improvements to the methods and apparatus described above and to solutions to the problems raised or not solved thereby.

Briefly summarized, this invention provides a device for recycling developer fixer into a photo processing machine which includes containers for containing chemicals coming out of overflow outlets of the photo processing machine. The chemicals flow into the container, and a portion thereof are recycled and returned together with fresh chemicals to the processing machine. A portion of the used chemicals are discharged to a drain. The recycled chemicals can either be pumped into an automixer where the fresh chemicals are added or directly into the inlet line to the photo processor tank where fresh chemicals are simultaneously also input. Alternately, the overflow can be directed to the automixer first and either returned directly therefrom, or optionally, by way of a separate container, to the photo processing machine.

In accordance with a further embodiment of the invention, an automixer is not used, but rather, a metering pump controls the flow of chemical from a container in which the overflow is collected. The metering pump is connected by means of a fluid flow line through a suitable junction such as a "T" or "Y" fitting into the flow line through which fresh chemical is pumped from a chemical replenishment tank into the inflow inlet of the photo processing machine.

The invention relates to devices for recycling chemicals in a photo processing machine. Generally, a photo processing machine has at least overflow outlets and bulk chemical storage tanks for developer and fixer liquids. An automixer of the specific gravity controlled type may also be employed. Such an automixer contains tanks for mixing photographic chemicals and inputting them into the photo processing machine and automatically redilutes the system with additional water, when needed, to maintain the prescribed specific gravity.

According to one embodiment of the invention, the recycling device includes a container for containing fixer coming out of the fixer overflow outlet of the photo processing machine. This fixer enters via an inlet into the container, connected to the fixer overflow outlet. The container has at least one overflow outlet therein, positioned so as to permit the outflow of fixer from the container when the level of the fixer reaches a predetermined level in the container. The invention further may use a pump for pumping the fixer from the container into an automixer fixer tank. This pump is energized by the same control that controls the solenoid valve introducing fresh fixer into the automixer fixer tank and which automatically redilutes the fixer with water to replace evaporation losses. Means are provided for shutting off the pump when there has been a predetermined amount of fixer pumped from the container into the automixer fixer tank or back into the fixer input line to the film processor. Additional overflow outlets may be provided, positioned at different levels than the overflow outlet first referred to above. These additional overflow outlets permit the operator to selectively permit the outflow of fixer from the container when the level of the fixer reaches a different the respective different levels. A filter on the order of 5 to 10 microns may be positioned in line between the pump and the automixer fixer tank, for filtering out solids in the recycled fixer. Preferably the inlet into the container is positioned at the bottom of the container so as to reduce agitation of the fixer on introduction.

In another embodiment of the invention either fixer or developer can be received in a surge tank from the photo processor overflow outlet. In accordance with this embodiment, the need for an automixer is eliminated. Instead, a portion of the spent chemicals are discharged from the surge tanks for disposal while and amount, preferably equal to fifty per cent of the total inflow to the processor is pumped from the surge tank by means of a metered pump into the input line of the film processing machine.

In accordance with yet another embodiment of the invention, the overflow outlets of the photo processing machine are connected directly to an automixer of the specific gravity type where regeneration occurs by virtue of adding thereto fresh chemicals and water. This embodiment is preferred for low volume film processors due to the ability to accurately compensate for evaporation losses. This embodiment can dramatically reduce the amount of chemical required for replenishment, typically from about 100 to 150 cc per film to about 30 to 40 cc. Thus the quantity of chemical effluent waste is dramatically reduced. In this case the fixer can also be recirculated through a silver recovery device to remove silver and extend the useful life of the fixer.

Other objects and advantages of the invention will become apparent hereinafter.

DESCRIPTION OF THE PREFERRED EMBODIMENTS

Figure 1:
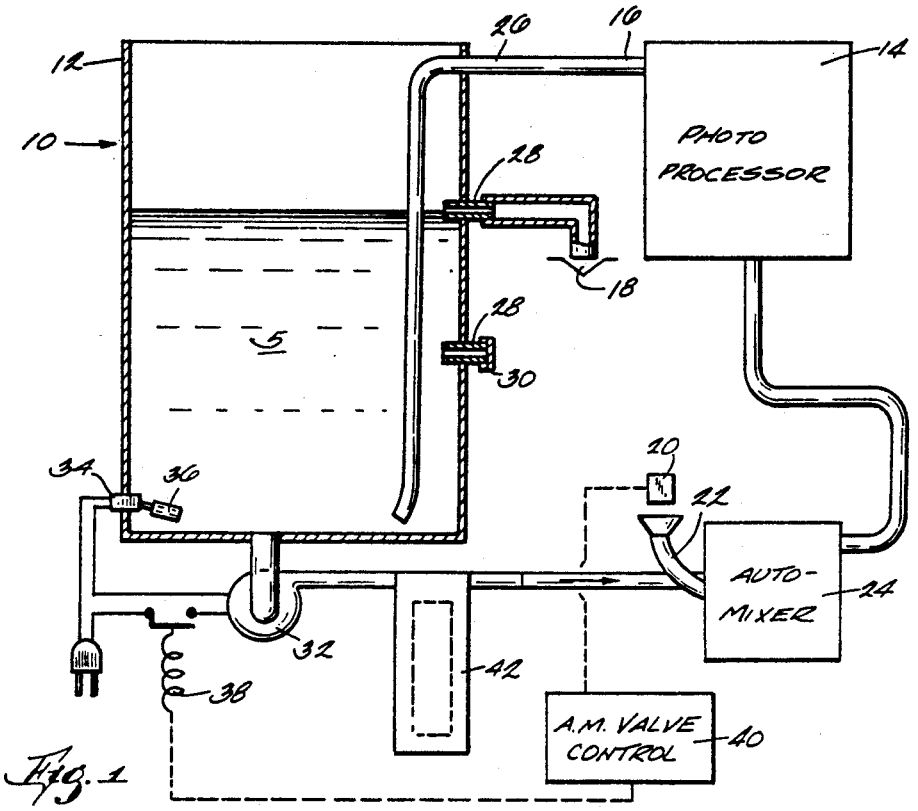
FIG. 1 is a side cross-sectional view, partially schematic, of an apparatus constructed according to an embodiment of the invention.

Referring now to the FIG. 1, it can be seen that the recycling apparatus 10 shown there, constructed according to a preferred embodiment of the invention, includes a container 12. It is irrelevant whether the top of the container 12 is open or not.

In a conventional photo processing system, a photo processing machine 14 has developer 3 contained in a tank 7 and fixer 5 contained in a tank 8. Tank 8 is provided with an overflow outlet 16, which is normally connected to a drain 18 or possibly some silver reclamation device which is in turn connected to the drain. In such a conventional system, the fresh photo fixer chemicals and water are introduced, by opening solenoid valve 20, into the chemical inlet 22 of an automixer 24, which mixes the chemicals before passing them into the photo processing machine 14. Wash fluid 9 contained in tank 11 is also contained in machine 14.

The conventional system, however, results in substantial waste of fixer and developer. Hence the present invention is provided to avoid this waste. To that end, in the embodiment of FIG. 1, a container inlet 26 is provided to the container 12. This container inlet 26 is connected to the overflow outlet 16 of fixer tank 8 of the processing machine. Because it can be detrimental to certain of the chemicals contained in the fixer, the container inlet 26 is constructed to minimize agitation of the fixer upon introduction of the fixer into the container. Hence the outlet 26*a* of the container inlet 26 is positioned as near to the bottom of the container as possible.

The invention also calls for an overflow outlet 28, which is connected to the drain 18. The position of the overflow outlet 28 in effect determines the amount of fixer that will be recycled. In order to give control of this level to the operator of the apparatus 10, in one embodiment several overflow outlets may be provided. In the embodiment shown in the drawing figure, an upper overflow 28*a* and a lower overflow 28*b* are provided. Clearly, any overflow below that intended to be used must be capped, such as by a cap 30, shown attached over lower overflow 28*b*. Thus as fixer flows out of the photo processor 14, the container 12 fills, up to the level of the container overflow 28, after which time the fixer overflows to the drain or other disposal means.

Then, when it is time to add new fixer into the automixer 24, those chemicals are added via the chemical inlet 22 to the automixer, and the automixer is activated. At the same time, the fixer in the container 12 is pumped into the automixer 24, by means of a pump 32. As shown in the drawing figure, the pump 32 has an inlet at the bottom of the container 12. In order to prevent the pump 32 from running dry, the preferred embodiment of the invention includes a liquid level switch 34, having a float 36 positioned inside the container 12, near the bottom thereof. Thus when the level of the fixer in the container 12 is reduced to the level of the switch 34, the switch opens and de-energizes the pump 32.

In one embodiment, in order to facilitate the use of the apparatus 10, the pump 32 is energized by a relay 38 controlled by the same control 40 that controls the fresh fixer solenoid valve 20. Then whenever the fresh fixer solenoid 20 is opened, the pump 32 is also energized, to pump recycling fixer from the container 12 into the automixer 24.

In order to ensure that any solid or precipitated portions of fixer are removed, the invention may provide that the apparatus 10 includes a filter 42, in the line between the fixer recycling pump 32 and the automixer 24. Preferably this filter will be on the order of a 5 to 10 micron filter, to properly catch the precipitates and still permit the free passage of the fixer.

Figure 2:
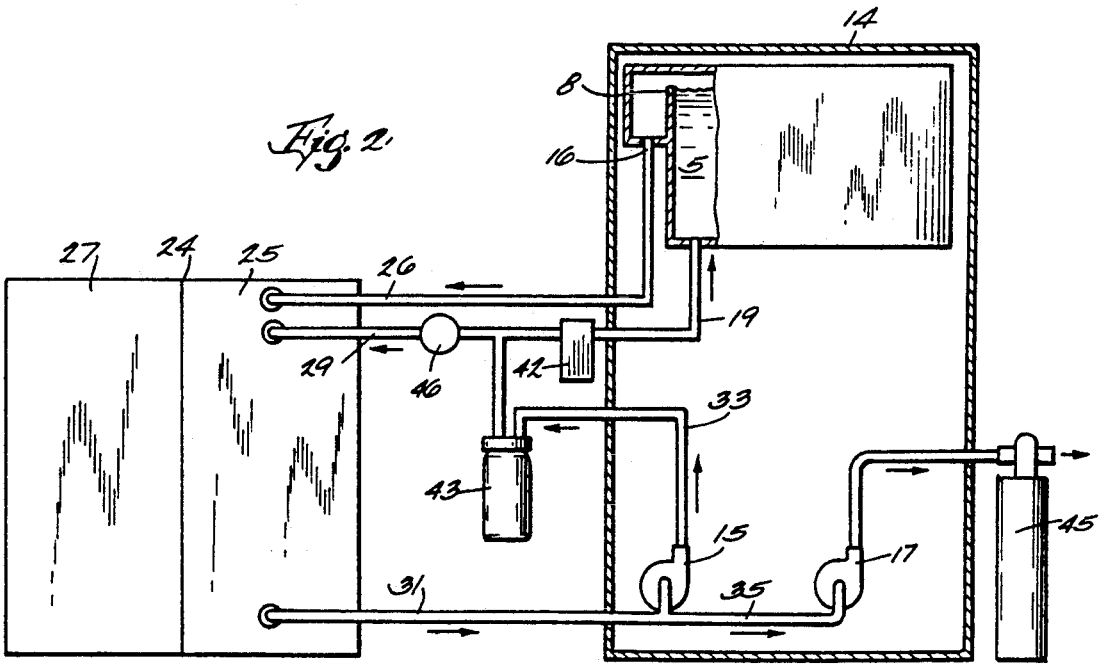
FIG. 2 is a side cross-sectional view, partially schematic, of an apparatus constructed according to another embodiment of the invention.

Referring now to FIG. 2 there is seen an alternate embodiment in which a separate container such as container 12 of FIG. 1 is not utilized. Instead the overflow 16 of tank 8 is piped by a conduit 26 directly into automixer 24. Automixer 24 contains a fixer tank 25 and a developer tank 27. While the details for the piping and pumping arrangement are illustrated only for the fixer 5, a similar arrangement can be utilized with respect to the developer utilizing the developer tank 27 of automixer 24. In this arrangement the processor recirculating pump 15 draws fixer through a conduit 31 outflowing from tank 25. In order to avoid a build up of waste products in the system a portion of the fixer is pumped by means of the processor replenishment pump 17 through conduit 35 to discharge in a drain. It is desirable to utilize a silver reclamation device 45 of a commercially available type such as a Silver Trap Window Series® metallic replacement silver recovery device marketed by USI, Inc. of West Bend, Wis.

Fixer that is recycled is caused to flow by pump 15 through conduit 33 through a silver reclamation device 43 which is preferably of the electronic or electrolytic type.

A portion of the recirculating fixer is passed through a flow control and back to tank 25 by means of return line 29. The remainder passes through a filter 42 and then through intake line 19 back into tank 8 of the photo processing machine 14.

Figure 3:
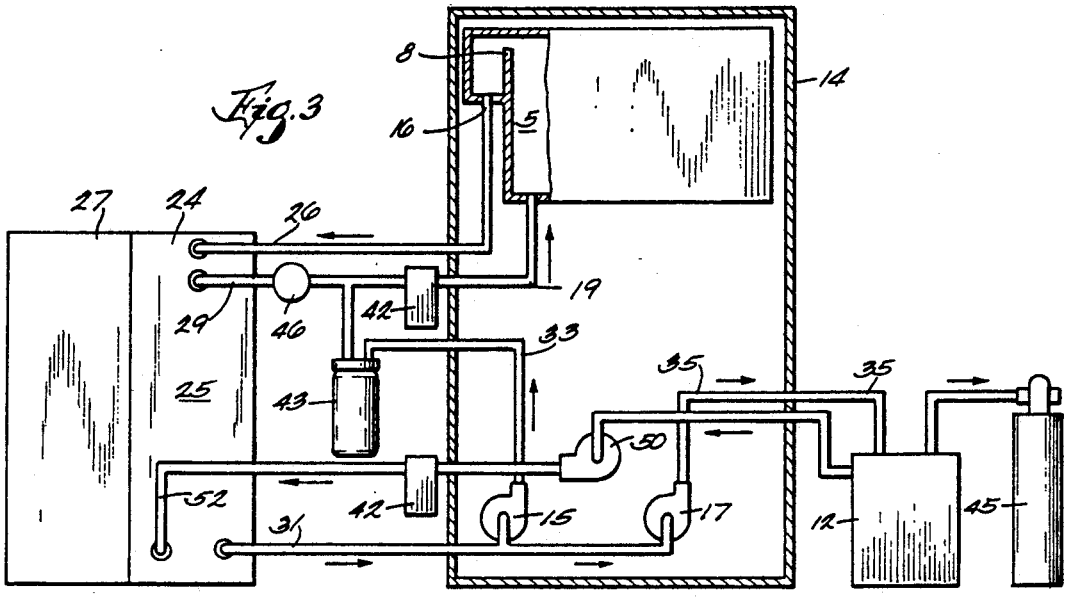
FIG. 3 is a side cross-sectional view, partially schematic, of an apparatus constructed according to another embodiment of the invention, and, FIG. 4 is a side cross-sectional view, partially schematic, of an apparatus constructed according to still another embodiment of the invention.

Referring to FIG. 3 there is seen a further embodiment in which a container 12 is utilized in connection with the overall arrangement shown in FIG. 2. In this case the material pumped by replenishment pump 17 flow by means of conduit 35 into container 12. An additional pump 50 returns a portion of the materials from container 12 back to the automixer tank 25 through a return line 52. A filter 42 may be used on this line as shown.

In both of the embodiments shown in FIGS. 2 and 3, the correct amount of water in the fixer is controlled by automixer 24 due to the fact that it is of a specific gravity type. If evaporation losses occur, water is automatically added by the automixer until the correct specific gravity is once again obtained.

Figure 4:
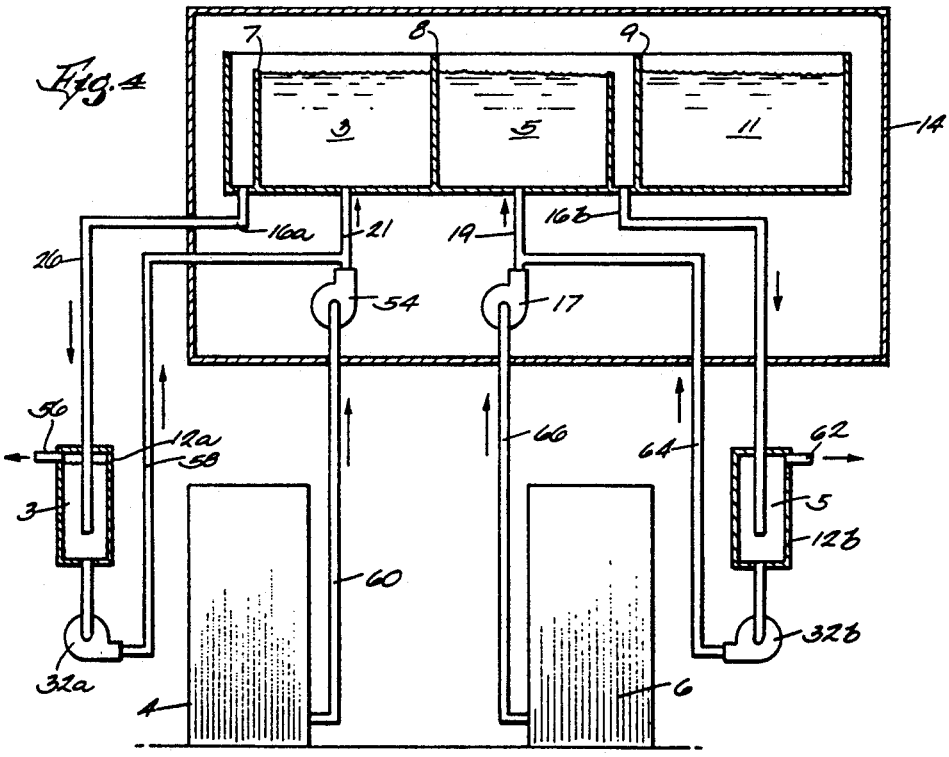

FIG. 4 represents a further embodiment in which both the fixer 5 and developer 3 are recirculated without the expense of an automixer. In this embodiment the developer 3 outflows through overflow line 16*a* by means of conduit 26 into a surge tank 12*a*. An amount of the developer generally approaching approximately 50% is discharged from the surge tank 12a through an overflow 56 into a suitable drain. The remainder is recirculated by pump 32a by means of return line 58 into fluid flow line 21. Fresh developer is contained in a developer replenishment tank 4 from where it is pumped when required by means of a pump 54 through line 60 into line 21, where it flows together with the recycled liquid into tank 7. By approximately equalizing the flow through conduits 58 and 60 by appropriately controlling metering pumps 32a and 54, a dramatic saving in terms of developer consumed and pollutants discharged into the drain can be achieved.

In similar fashion the overflow from fixer tank 8 is directed through an outflow line 16b into a surge tank 12b from whence a portion is discharged via overflow 62 to a drain. The balance is pumped by a metering pump 32b into a return line 64 which is joined to an input line 66 connected to fixer replenishment tank 6 which contains fresh fixer. As needed, fixer from tank 6 is pumped by means of replenishment pump 17 into tank 8 to replace fixer 5 which has been consumed by the developing process. The flows from line 64 and 66 are mixed at their junction, which may be a "T" or "Y" connection and flow together through line 19 into tank 8.

While the apparatus hereinbefore described is effectively adapted to fulfill the aforesaid objects, it is to be understood that the invention is not intended to be limited to the specific preferred embodiment of fixer recycler in connection with photo processing machine set forth above. Rather, it is to be taken as including all reasonable equivalents within the scope of the following claims.

I claim:

1. A device for recycling a liquid chemical selected from the group consisting of fixer solution and developer solution into a photo processing machine, said photo processing machine having a fixer tank with an inlet and an overflow outlet and a developer tank with an inlet and an overflow outlet, and a metering pump for inputting chemicals into each of said tanks, said device comprising:

at least one container for receiving and containing a chemical liquid flowing from one of said overflow outlets;

an inlet into said container, connected to the overflow outlet, for permitting said chemical liquid to flow from the overflow outlet into said container;

a pump for pumping said chemical liquid from said container into the inlet of one of said photo processing machine tanks, and means for adding fresh chemical liquid to said chemical liquid at a point between said overflow outlet and said inlet wherein said container is connected by fluid flow lines to an automixer for flow of said chemical liquid from said container to said automixer and said fresh chemical is added into said automixer.

2. A device according to claim 1 wherein said container comprises a tank in said automixer and the chemical liquid is returned therefrom to the input line of the photo processing machine.

3. A device according to claim 2 wherein said automixer is of the specific gravity type which controls the introduction therein of water to maintain the fixer at a prescribed amount of dilution.

4. A device according to claim 3 provided with fluid flow lines whereby the chemical liquid is pumped from the automixer to another container, and with a further fluid flow path whereby a portion of the chemical liquid is returned by means of the input to the tank in said photo processing machine.

5. A device for recycling fixer into a photo processing machine, said photo processing machine having a fixer overflow outlet and an automixer, having an automixer fixer tank, for mixing photographic chemicals and inputting them into the photo processing machine, said device comprising:

a container for containing fixer;

an inlet into said container, connected to the fixer overflow outlet, for permitting fixer to flow from the fixer overflow outlet into said container;

said container having at least one overflow outlet therein, positioned so as to permit the outflow of fixer from said container when the level of the fixer reaches a predetermined level in the container;

a pump for pumping the fixer from the container into the automixer fixer tank, said pump being energized by the same control that controls the pumping of fresh fixer into the automixer fixer tank; and means for shutting off the pump when there has been a predetermined amount of fixer pumped from the container into the automixer fixer tank.

6. A device for recycling fixer as recited in claim 5 further comprising at least one additional overflow outlet, positioned at a different level than said at least one overflow outlet, for permitting the outflow of fixer from said container when the level of the fixer reaches a different level.

7. A device for recycling fixer as recited in claim 5 further comprising a filter, positioned in line between the pump and the automixer fixer tank, for filtering out solids in the recycled fixer.

8. A device for recycling fixer as recited in claim 5 wherein said filter is on the order of 5 to 10 microns.

9. A device for recycling fixer as recited in claim 5 wherein said inlet into said container is positioned at the bottom of said container so as to reduce agitation of the fixer already in the container with the introduction of fixer into the container.

10. A device for recycling fixer as recited in claim 5 wherein said pump connects to said container by means of a pump inlet, said pump inlet being positioned at the bottom of the container.

11. A device according to claim 5 wherein said automixer is of the specific gravity type which controls the introduction therein of water to maintain the fixer at a prescribed amount of dilution.

* * * * *